US007469810B2

(12) United States Patent
Strååt et al.

(10) Patent No.: US 7,469,810 B2
(45) Date of Patent: Dec. 30, 2008

(54) RELEASABLE STAPLE MAGAZINE WITH A RELEASABLE STAPLE FORMING ARRANGEMENT

(75) Inventors: Olle Strååt, Hestra (SE); Marcus Börjesson, Hestra (SE)

(73) Assignee: Isaberg Rapid AB, Hestra (SE)

( * ) Notice: Subject to any disclaimer, the term of this patent is extended or adjusted under 35 U.S.C. 154(b) by 0 days.

(21) Appl. No.: 10/544,810

(22) PCT Filed: Jan. 30, 2004

(86) PCT No.: PCT/SE2004/000120

§ 371 (c)(1),
(2), (4) Date: Jun. 13, 2006

(87) PCT Pub. No.: WO2004/069486

PCT Pub. Date: Aug. 19, 2004

(65) Prior Publication Data

US 2006/0255087 A1 Nov. 16, 2006

(30) Foreign Application Priority Data

Feb. 6, 2003 (SE) ..... 0300298

(51) Int. Cl.
*B25C 5/00* (2006.01)

(52) U.S. Cl. ..... 227/120; 227/87; 227/131; 227/136

(58) Field of Classification Search ..... 227/119, 227/120, 131, 82, 87, 88, 136, 137, 138
See application file for complete search history.

(56) References Cited

U.S. PATENT DOCUMENTS 3,009,156 A * 11/1961 Lerner ..... 227/88
4,573,625 A * 3/1986 Olesen et al. ..... 227/131
4,583,276 A 4/1986 Olesen
4,588,121 A 5/1986 Olesen
5,346,114 A * 9/1994 Udagawa et al. ..... 227/120
5,560,529 A * 10/1996 Udagawa et al. ..... 227/136
5,723,199 A 3/1998 Boot ..... 227/87
5,794,833 A 8/1998 Str.ang..ang.t ..... 227/137
5,836,502 A * 11/1998 Kanai et al. ..... 227/131

(Continued)

FOREIGN PATENT DOCUMENTS

SE 9201230 A 5/1993

*Primary Examiner*—Scott A. Smith
(74) *Attorney, Agent, or Firm*—Miles & Stockbridge P.C.

(57) ABSTRACT

Staple magazine (7) for mounting to a stapler (1) used to staple together a workpiece (6), primarily a sheaf of papers, the said staple magazine comprising a container (8), in which elongated staple blanks (10) in the form of a strip (11) are stored, and a staple forming arrangement (9) comprising a forming punch (19), which bends the elongated staple blanks into the shape of a staple over a forming block (48), and a drive punch (20) with which the staple blanks which have been bent into staple shape for stapling the workpiece are driven into the said workpiece, the staple blanks stored in strip form being fed by a feeder plate (51) to a forming block (48) along a feed path (44) incorporated in the container, and the forming punch and drive punch being driven in a reciprocating bending and drive movement (P) by a drive arrangement (13-16) incorporated in the stapler, the container (8) and the staple forming arrangement (9) being connected to each other by means of releasable connecting devices (22, 23, 34, 35).

36 Claims, 14 Drawing Sheets

U.S. PATENT DOCUMENTS 6,039,230 A * 3/2000 Yagi et al. ..... 227/120
6,050,471 A * 4/2000 Yagi ..... 227/119
6,371,352 B1 * 4/2002 Mochizuki ..... 227/155
6,557,744 B2 * 5/2003 Kitamura ..... 227/119
6,568,579 B2 * 5/2003 Mochizuki ..... 227/131
6,641,023 B2 * 11/2003 Strååt et al. ..... 227/121
6,715,654 B2 * 4/2004 Sugihara et al. ..... 227/2
6,913,181 B2 * 7/2005 Mochizuki et al. ..... 227/120

* cited by examiner 1
2
3
4
5
6
7
8
9
12
13
14
15
16
17
P

47
L
46
12
10
11
51
54
53
52
54
52
45
45
42
49
44
48

RELEASABLE STAPLE MAGAZINE WITH A RELEASABLE STAPLE FORMING ARRANGEMENT

TECHNICAL FIELD

The present invention relates to a staple magazine for mounting to a stapler used to staple together a workpiece, primarily a sheaf of papers, the said staple magazine comprising a container, in which elongated staple blanks in the form of a strip are stored, and a staple forming arrangement comprising a forming punch, which bends the elongated staple blanks into the shape of a staple over a forming block, and a drive punch with which the staple blanks which have been bent into staple shape for stapling the workpiece are driven into the said workpiece, the staple blanks stored in strip form being fed by a feeder plate to a forming block along a feed path incorporated in the container, the forming punch and drive punch being driven in a reciprocating bending and drive movement by a drive arrangement incorporated in the stapler, and the staple magazine being replaced when the staples have been used.

In accordance with another aspect of the present invention the invention relates to a container designed to form part of a staple magazine, which staple magazine is designed to be mounted to a stapler used to staple together a workpiece, primarily a sheaf of papers, the said staple magazine comprising a container, in which elongated staple blanks in the form of a strip are stored, and a staple forming arrangement comprising a forming punch, which bends the elongated staple blanks into the shape of a staple over a forming block, and a drive punch with which the staple blanks which have been bent into staple shape for stapling the workpiece are driven into the said workpiece, the staple blanks stored in strip form being fed by a feeder plate to a forming block along a feed path included in the container, the forming punch and drive punch being driven in a reciprocating bending and drive movement by a drive arrangement incorporated in the stapler, and the staple magazine being replaced when the staples have been used.

STATE OF THE ART

A staple magazine or a container of the type described above is already known and, for example, is described in the applicant's own patent SE 9201230-1. However, the disadvantage of these earlier devices is that the container and staple forming arrangement are permanently attached to each other in a manner which prevents their separation from each other without destruction. This means that when the staple magazine has been emptied of its contents, both the container and staple forming arrangement must be replaced, which is unnecessarily expensive and represents a significant waste.

Another disadvantage of the earlier devices is that they are not equipped with a forming block, which is instead located in the stapler. This means that the staple magazine or the container must be mounted accurately relative to the forming block, which may be difficult and at the same time present a significant risk that the forming block will become worn following a number of magazine replacements, which may lead to incomplete forming of the staples.

Yet another disadvantage is that since the feed path is made of a plastic material and the staple blanks are made of metal, a large clearance must be provided between the inner walls of the feed path and the sides of the staple strip to ensure that the staple blank do not jam against the inner walls when the blanks are fed forward. This means, however, that staple blanks can become displaced laterally relative to the forming block, causing the blanks to be bent into an unsymmetrical staple shape.

A final disadvantage is that since the feeder plate is located in the stapler, it must be compatible with every magazine or container installed in the stapler to ensure satisfactory operation and the magazines must, therefore, be manufactured to a high degree of precision.

Problem

Thus, there exists a need to manufacture a magazine or a container of such design that the complete magazine need not be disposed of when all of the staples have been used.

There exists, further, a need for a magazine or a container provided with a forming block of such design that it does not become worn to a point at which the quality of staple forming becomes unacceptable.

There exists, yet further, a need to provide a magazine or a container with a feed path which is so narrow relative to the staple strip that there is no risk of bending a staple into an unsymmetrical shape.

There exists, finally, a need to provide a magazine or a container of such design that it is unnecessary to adjust the staple magazine relative to the feeder plate when the staple magazine is installed in the stapler.

Solution

The present invention overcomes the aforementioned disadvantages by means of a staple magazine of the type described in the introduction, which is characterised in that the container and staple forming arrangement are connected to each other by releasable connecting devices.

The present invention is further characterised in that the said connecting devices are provided with one or more openings/cavities in the staple forming arrangement and catching devices in the container corresponding to the openings/cavities, which catching devices are engaged in the openings/cavities to ensure secure connection between the container and, staple forming arrangement.

The present invention is yet further characterised in that the forming block is integrated with the container.

The present invention is even yet further characterised in that the inner walls of the feed path are made of a metallic material.

The present invention is further even yet further characterised in that the width of the feed path is negligibly wider than that of the staple strip.

The present invention is also characterised in that the feeder plate is attached to the container part.

In accordance with another aspect of the present invention the present invention overcomes the aforementioned disadvantages by means of a container of the type described in the introduction, which is characterised in that the container is releasably connectable to the staple forming arrangement by releasable connecting devices.

In accordance with the other aspect is the invention further characterised in that the said connecting devices are provided with one or more openings/cavities in the staple forming arrangement and catching devices in the container corresponding to the openings/cavities, which catching devices are engaged in the openings/cavities to ensure secure connection between the container and staple forming arrangement.

In accordance with the other aspect the invention is yet further characterised in that the forming block is integral with the container.

In accordance with the other aspect the invention is even yet further characterised in that the inner walls of the feed path are made of a metallic material In accordance with the other aspect the invention is further even yet further characterised in that the width of the feed path is negligibly wider than that of the staple strip.

In accordance with the other aspect the invention is also characterised in that the feeder plate is attached to the container part.

BRIEF DESCRIPTION OF FIGURES

The invention will hereinafter be described with reference to a preferred embodiment, which is shown in the appended figures, of which.

PREFERRED EMBODIMENT

Figure 1:
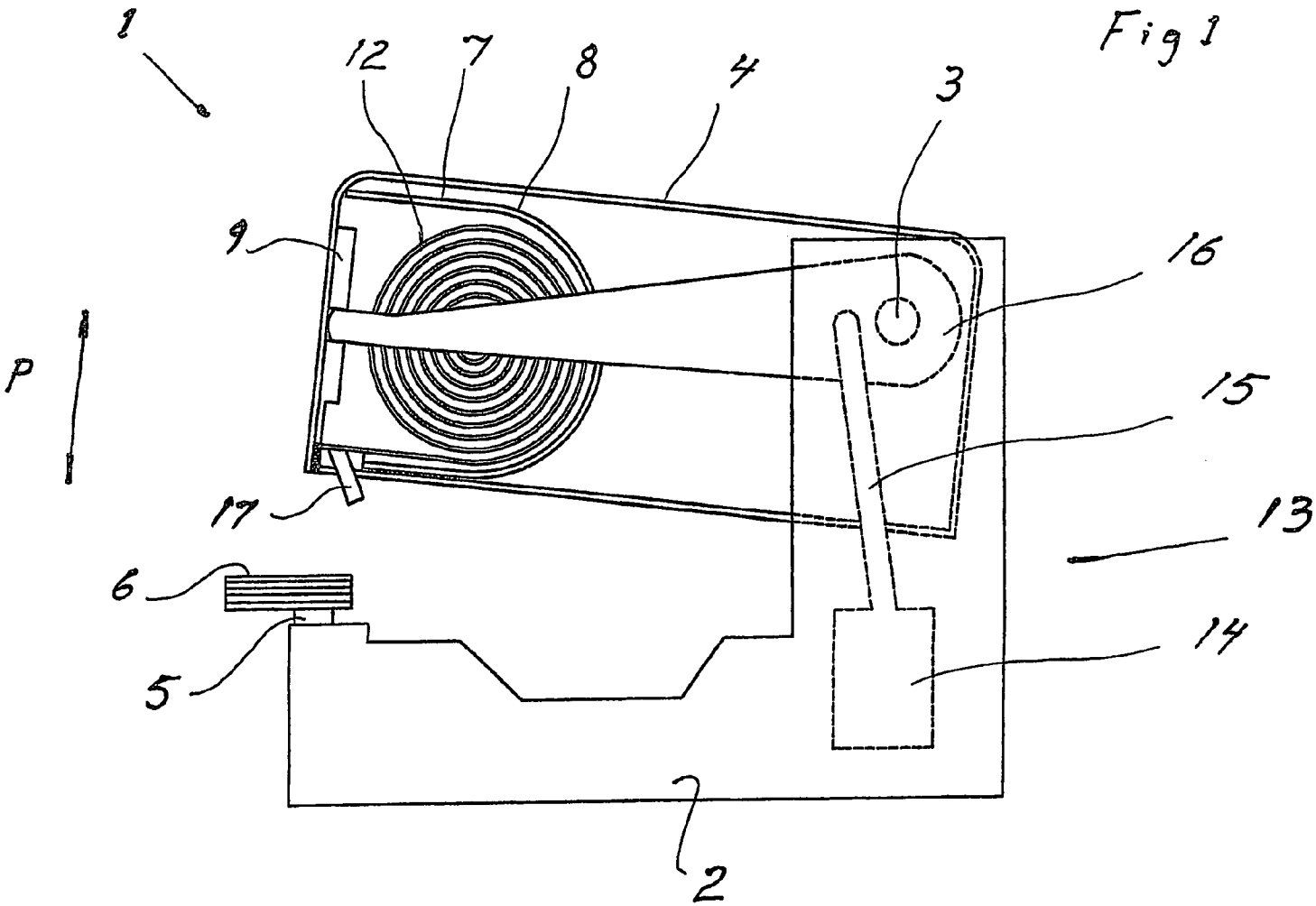
FIG. 1 is a schematic view of a stapler.
Figure 2:
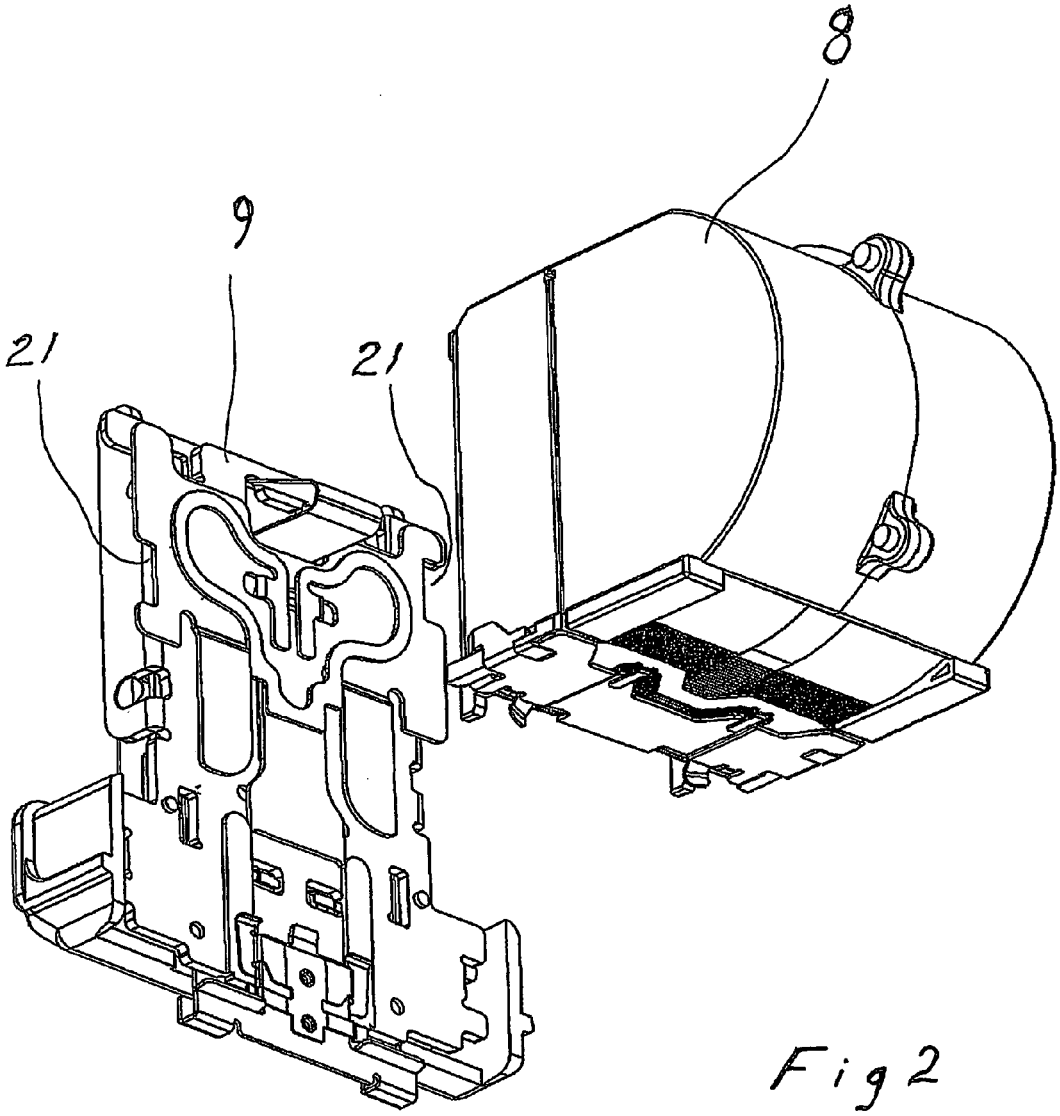
FIG. 2 shows a staple magazine in accordance with the present invention, in which the container and staple forming arrangement have been separated.
Figure 3:
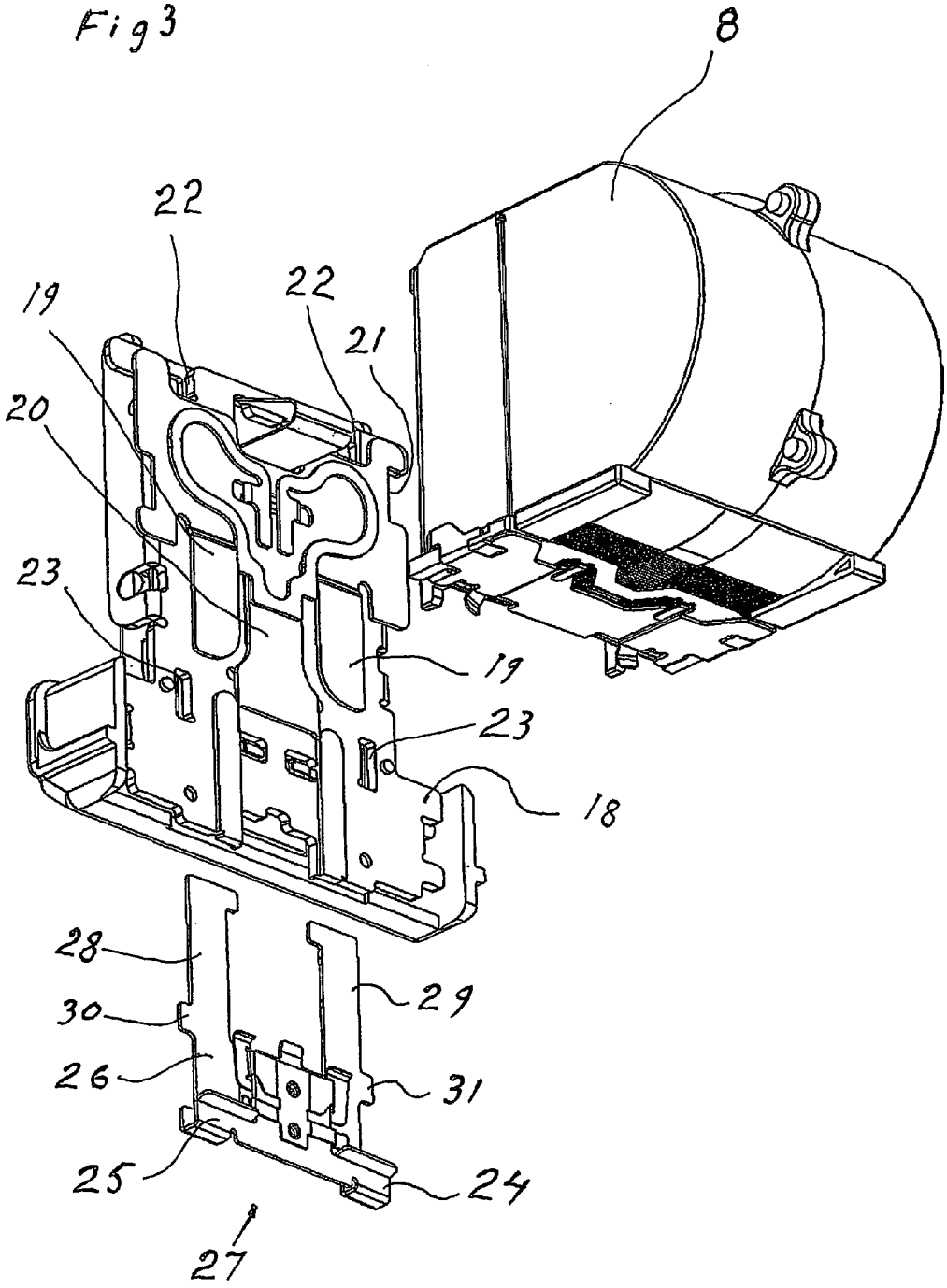
FIG. 3 is a view corresponding to FIG. 2, with a part which is essential for connecting the container and staple forming arrangement together shown exposed.
Figure 4:
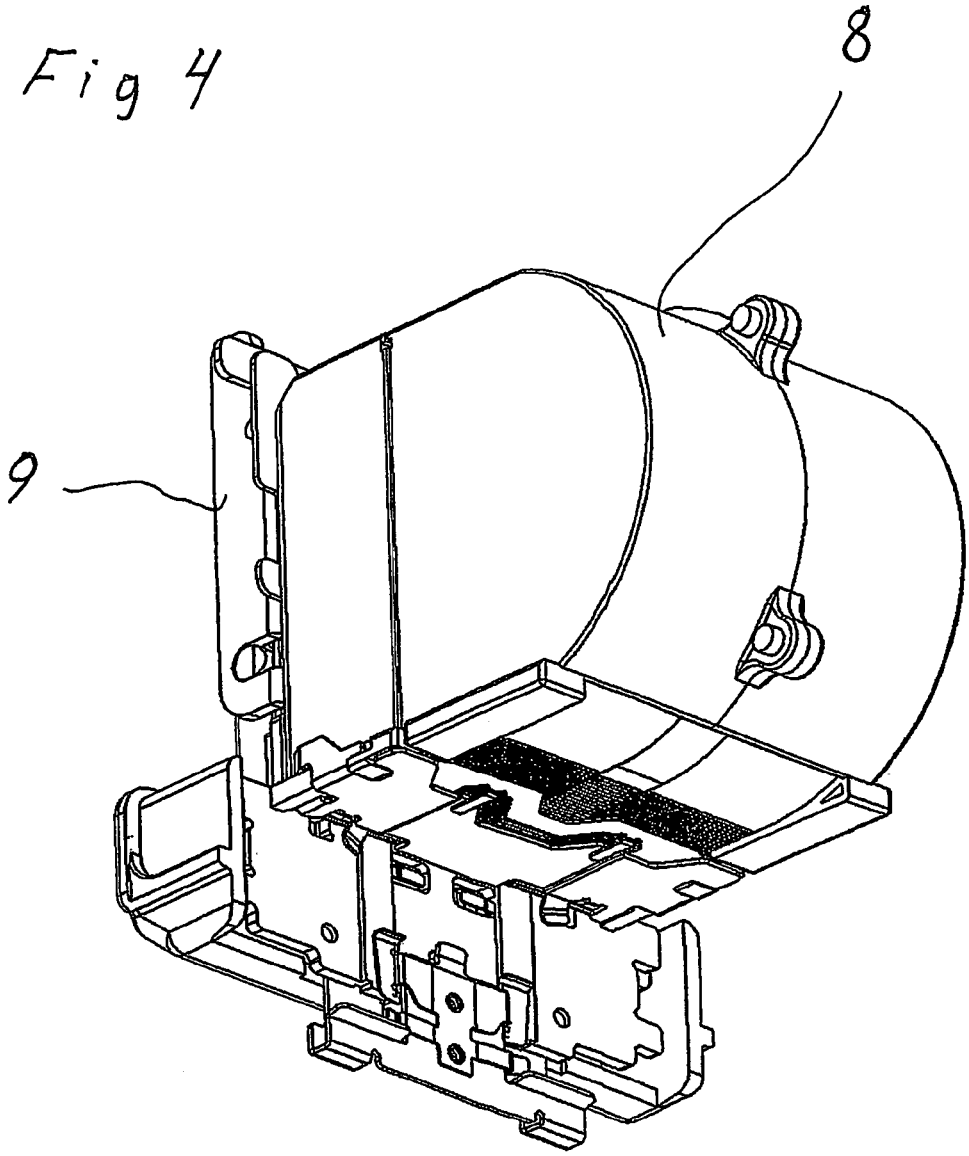
FIG. 4 is a view in which the container and staple forming arrangement have been assembled together, but have not yet been connected securely to each other.
Figure 5:
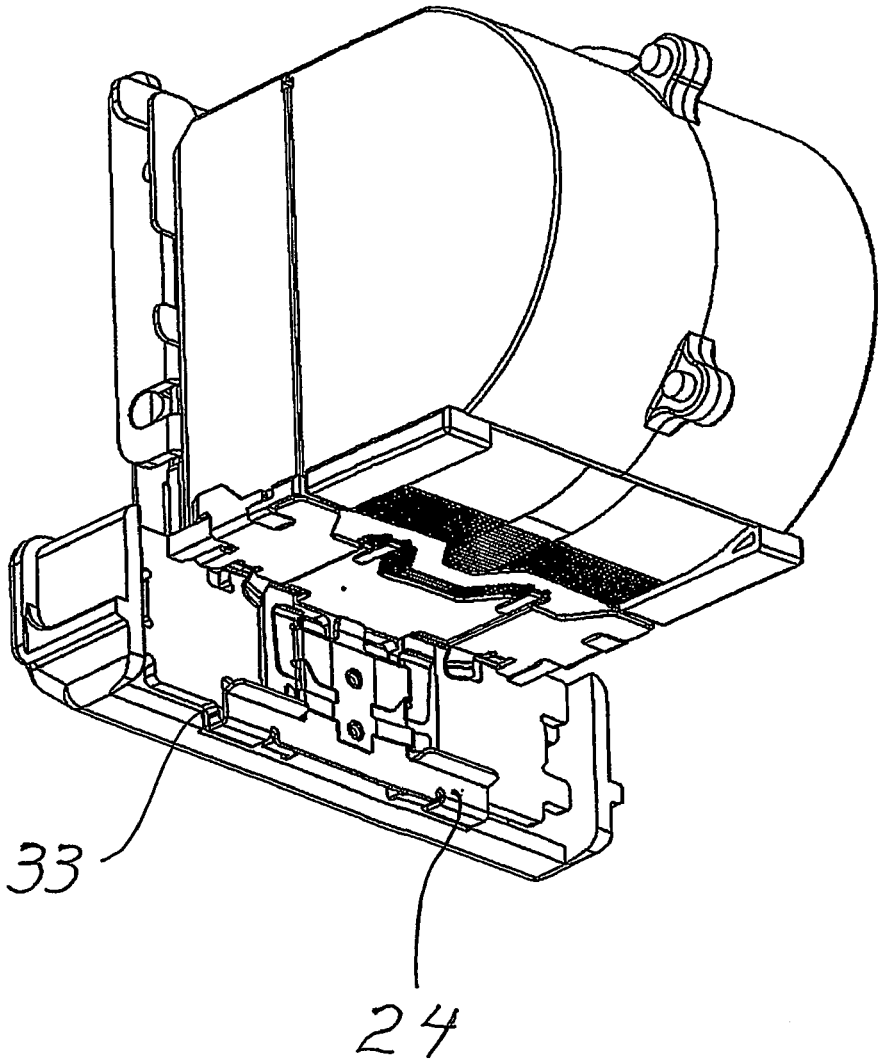
FIG. 5 is a view corresponding to FIG. 4 in which the parts have been connected securely to each other.

FIG. 1 is a schematic view of a stapler 1 comprising a base part 2 and a stapler head 4, which is pivotably connected to the base part by means of a pivot pin 3. The base part is provided with an anvil surface 5 on which the workpiece 6 to be stapled is placed. The stapler head houses a staple magazine 7 comprising a container 8 and a staple forming arrangement 9. The container contains staple blanks 10 which, in known manner, are joined side by side to form a staple strip 11, see FIG. 10, which is stored in the form of a reel 12. The stapler is also provided with a drive arrangement 13 comprising a drive motor 14 which, by means of a linkage 15, drives the drive arms 16, only one of which is shown in the figures, which arms drive the stapler head and staple forming arrangement in a reciprocating stapling movement as indicated by the double arrow P. The stapler head is further provided with a feed device 17 which, as will be described later, acts on a feeder plate which feeds the staple strip 11 forward during a stapling movement.

Figure 8:
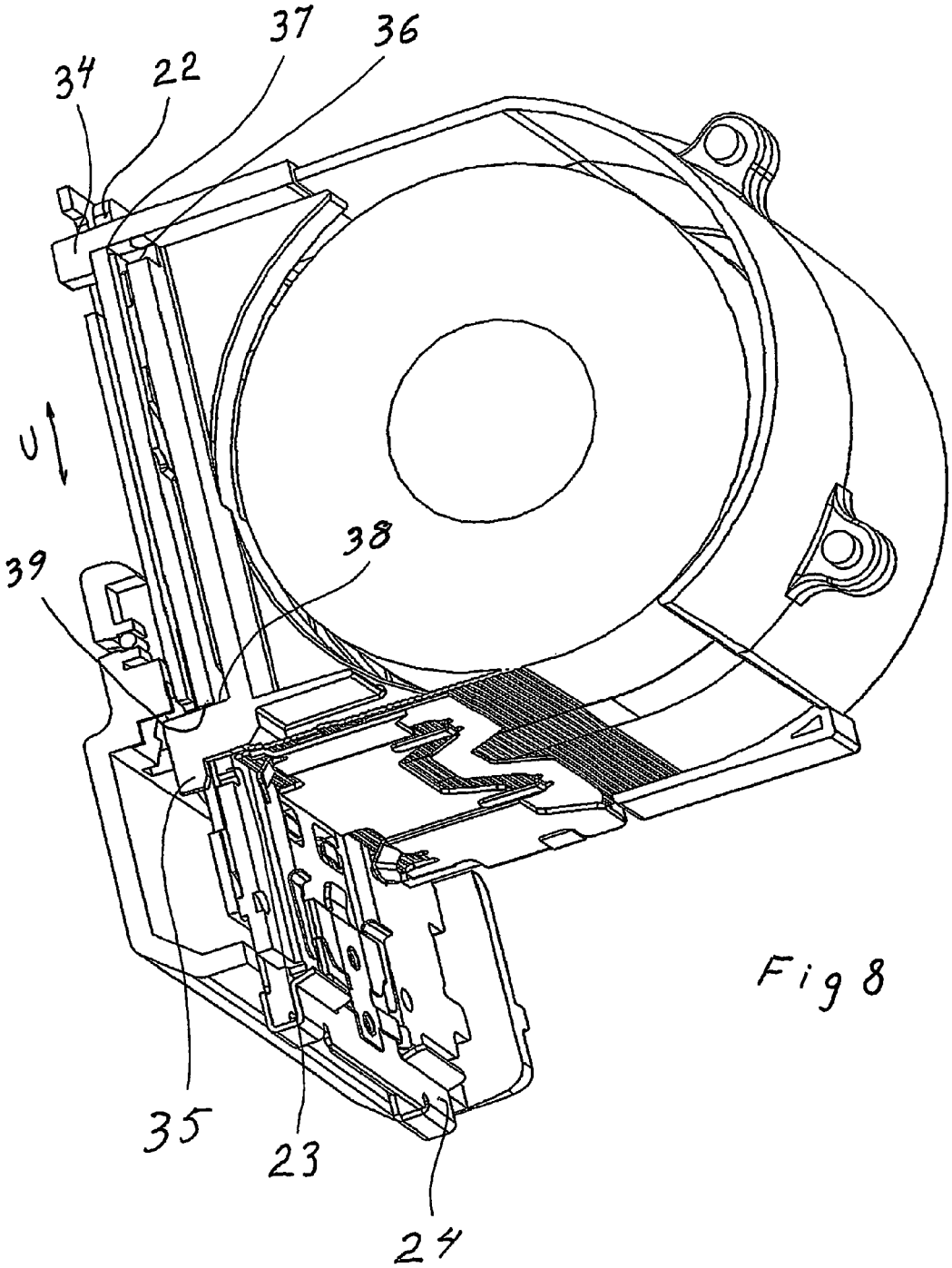
FIG. 8 is a view corresponding to FIG. 4 in which the side facing the viewer has been made transparent.
Figure 9:
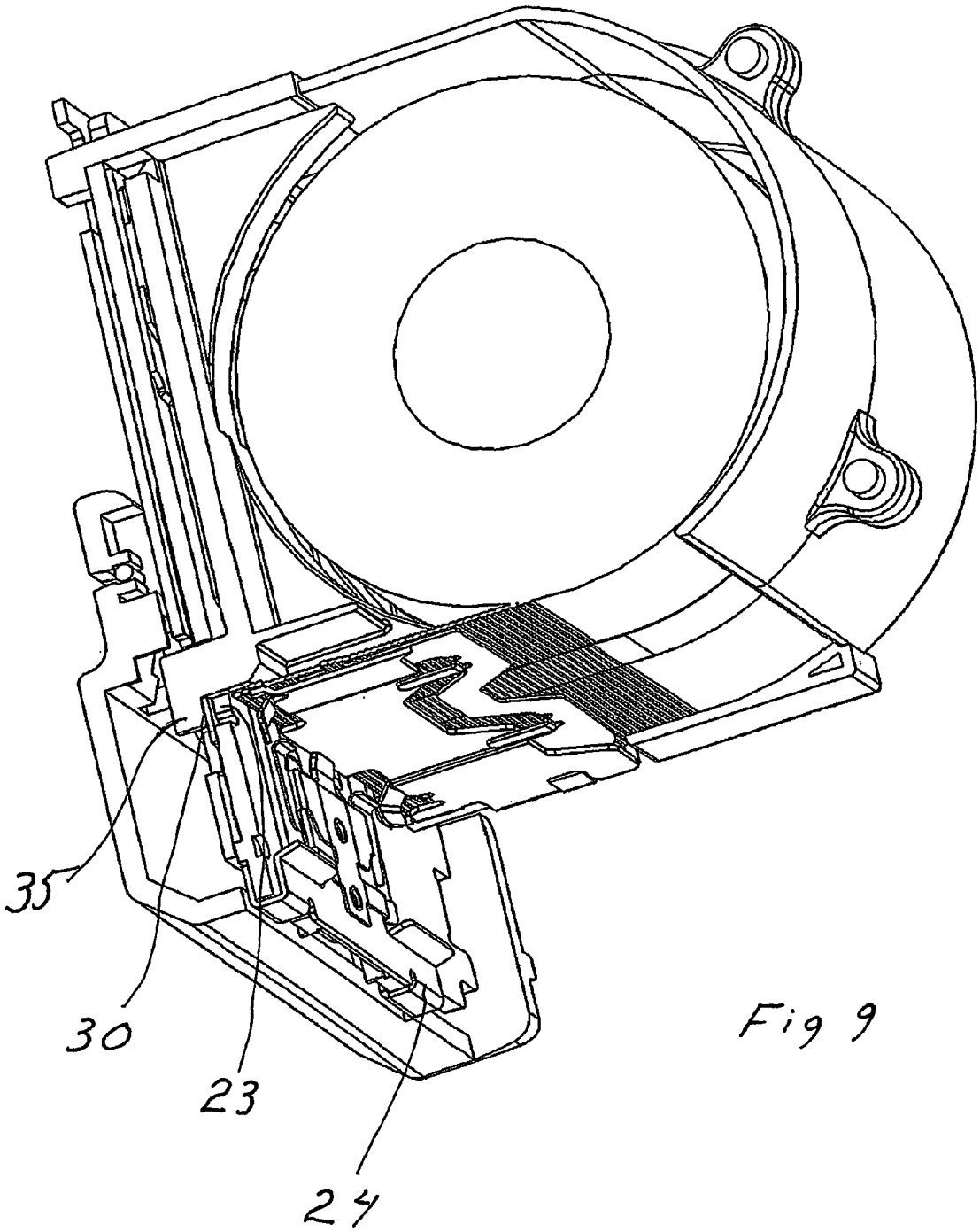
FIG. 9 is a view corresponding to FIG. 5 in which the side facing the viewer has been made transparent.

The container 8 and the staple forming arrangement 9 will hereinafter be described in detail with reference to FIGS. 2-9. The staple forming arrangement 9 comprises a base plate 18 provided, in known manner, with a forming punch 19 with an integral drive punch 20. The forming punch is provided with cutouts 21 which engage with and are acted upon by the drive arms 16, not shown in the figures, which arms causing the forming punch to be driven in a reciprocating stapling movement. The base plate 18 is provided with upper cavities 22 and lower openings 23. The base plate is further provided with a shackle 24 comprising a first shackle side 25 and a second shackle side 26. The first shackle side consists of an arrangement 27 whose function is to capture and guide the legs of the staple after the staple blank has been bent into the form of a staple. Since this function is not of significance to the present invention, it will not be described further. The second shackle side 26 is provided with two legs 28 and 29, each provided with a projection, 30 and 31 respectively. The shackle is fitted to the base plate 18 by positioning the shackle sides astride the base plate and, when the shackle is pushed in fully, the bottom 24 of the shackle abuts an edge area 33 of the base plate. The shackle is held securely in position by the fact that the bottom of the shackle is, in known manner, designed to clamp onto the edge area 33. When the shackle is pushed in fully to the position shown in FIG. 5, the projections 30 and 31 will be positioned partly in the areas of the respective openings 23 and the function of this relationship will be described below. The shackle 24 is guided laterally relative to the base plate by means of studs (not shown in the figures) located on the side on which the legs 28 and 29 are placed and against which the legs 28 and 29 are guided. The container 8 is provided with upper catches 34 and lower catches 35. The relative location of the catches is such that they engage in the cavities 22 and openings 23 respectively. To connect the staple forming arrangement 9 to the container 8, the shackle 24 is moved to the position shown in FIG. 2, the arrangement 9 is tilted relative to the container 8 and the catches 34 are engaged in the cavities 22, see FIG. 7, following which the container and arrangement are fitted together as shown in FIG. 8, in which the catches 35 are engaged respectively in the openings 23. In this position, the catches 34, with their respective undersides 36, are each in contact with a respective edge side 37 of the cavities 22, and each respective upper side 38 of the catches 35 is in contact with a respective edge side 39 of the openings 23. This ensures that the container 8 and the staple forming arrangement 9 cannot move relative to each other in the direction indicated by the double arrow U in FIG. 8. The shackle 24 is then moved to the position shown in FIG. 9, causing the projections 30 and 31 to be moved so that they partially cover the respective openings 23 in the base plate, thereby restricting the openings and ensuring that the catches 35 cannot be displaced from the openings 23, with the result that secure connection is established between the container and staple forming arrangement. To separate the container and staple forming arrangement, the shackle 24 is moved to the position shown in FIG. 8, whereupon the catches are disengaged from the openings and cavities, releasing the container from the staple forming arrangement and enabling it to be replaced by a new, full container.

Figure 6:
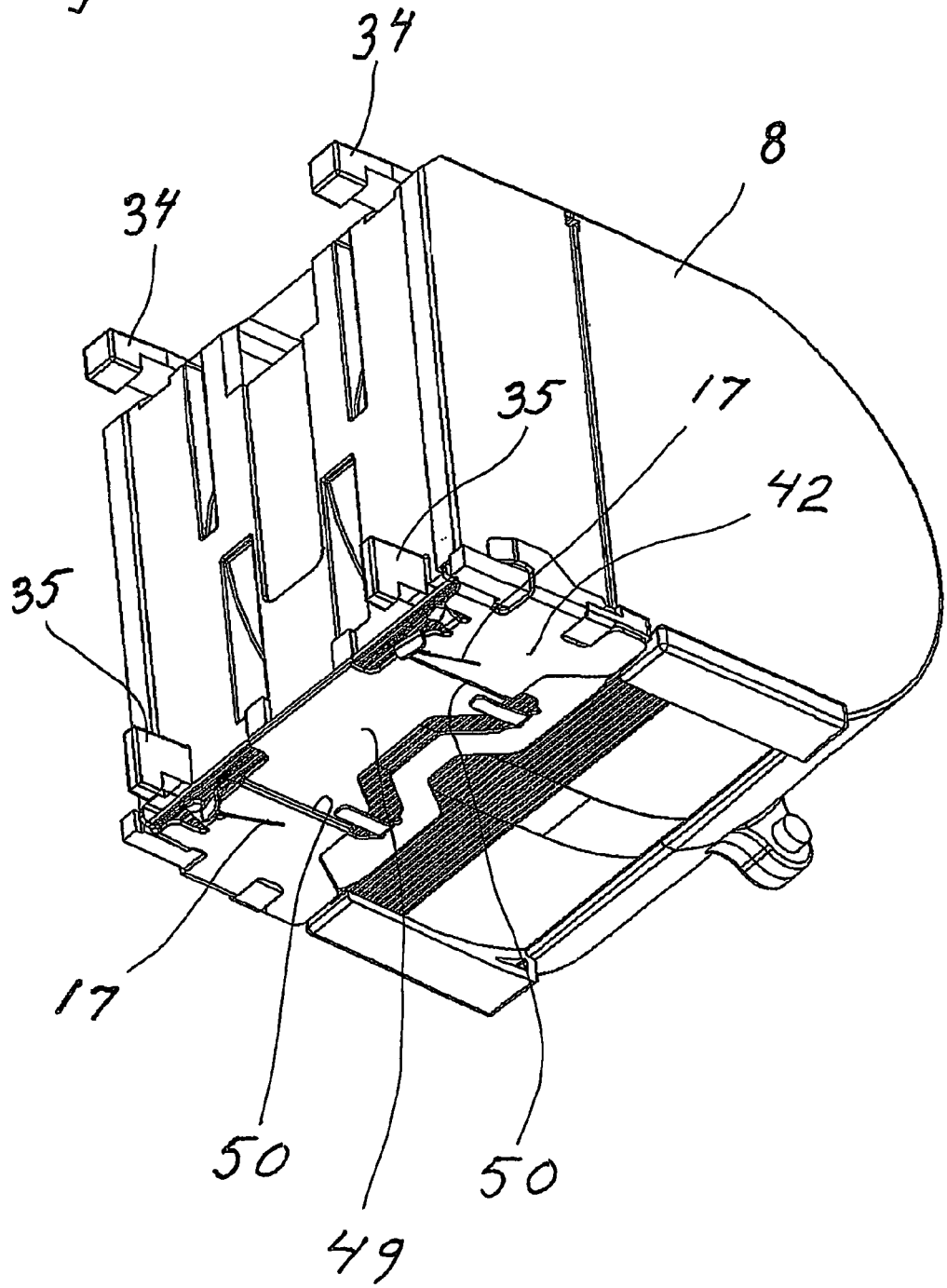
FIG. 6 is a view showing the staple magazine container.
Figure 7:
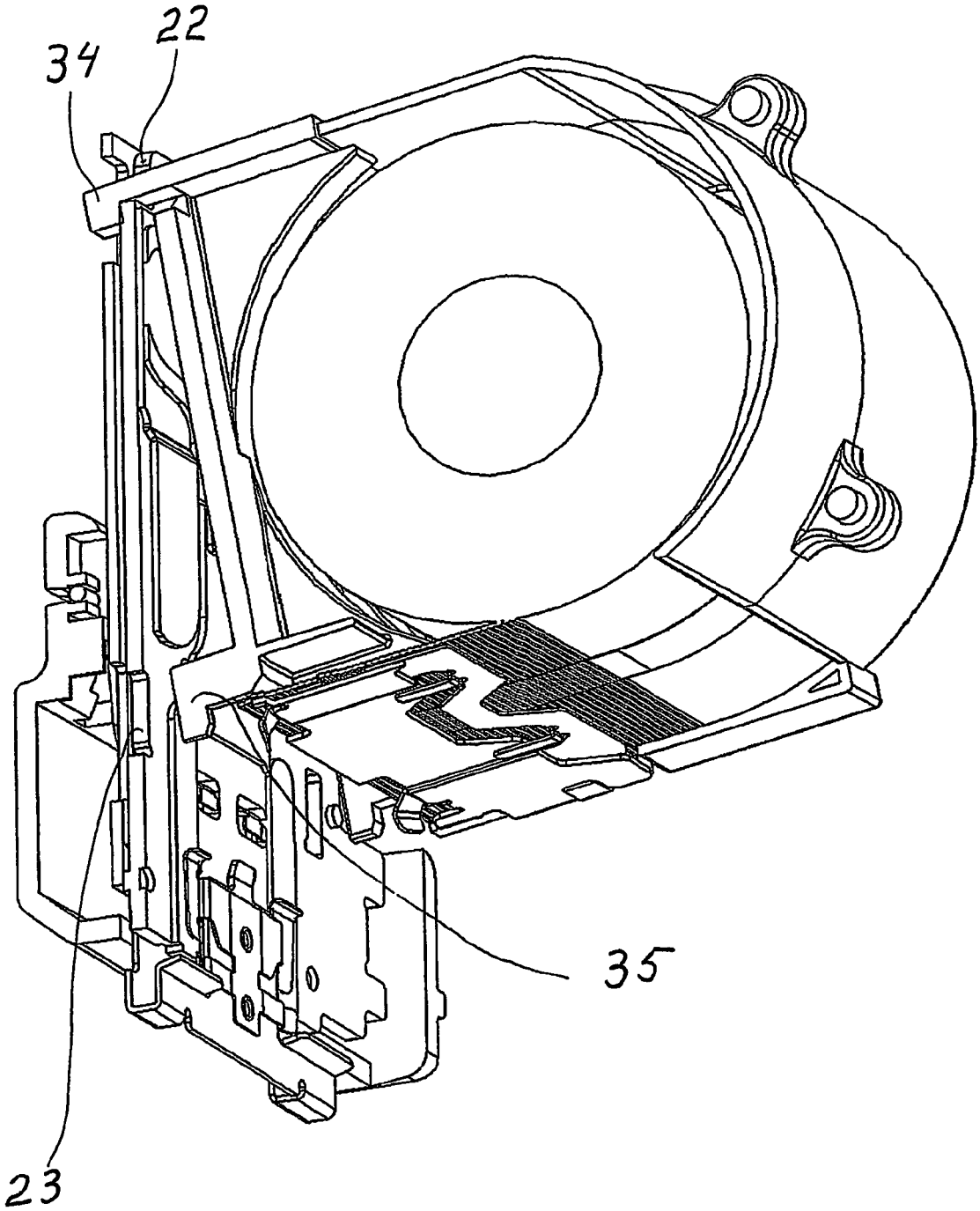
FIG. 7 is a view in which the side facing the viewer has been made transparent and in which connection of the container to the staple forming arrangement has been commenced.
Figure 10:
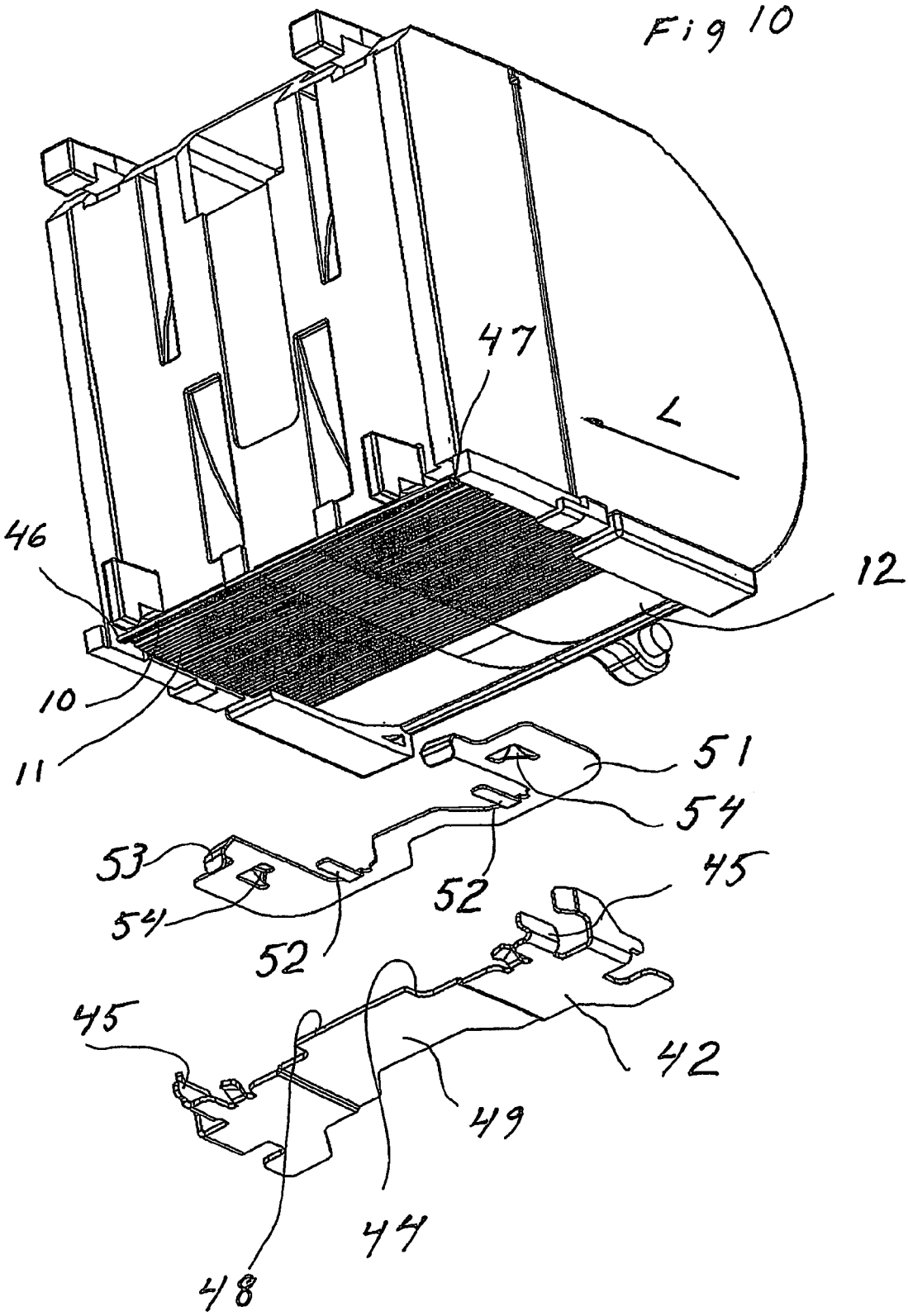
FIG. 10 is a view of the container, with parts essential to the invention shown exposed.
Figure 11:
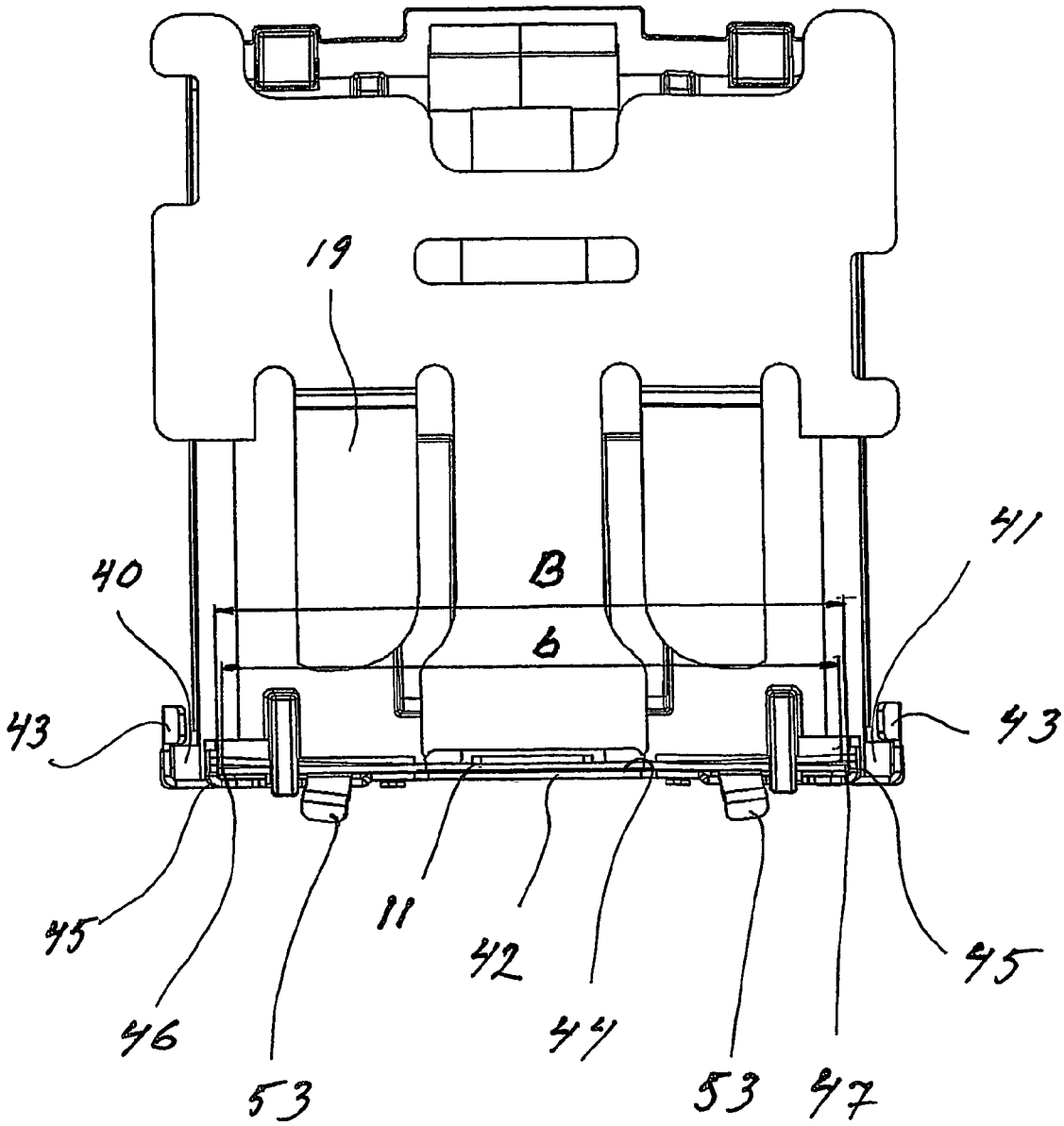
FIG. 11 shows the container as viewed from the side which is to be connected to the staple forming arrangement.

FIGS. 6, 10 and 11 show the container 8, in which the staple strip reel 12 comprising the staple strip 11 is housed. The container 8 is provided with a first rim 40 and a second rim 41, which rims extend essentially in the same direction as the longitudinal direction of the staple strip as indicated by the arrow L in FIG. 10. Extending between the rims 40 and 41 is a plate 42 provided with spring clips 43 with which the plate is clipped to the rims 40 and 41 respectively. The plate 42 is provided with a feed path 44 along which the staple strip 11 is fed. The width B of the feed path is limited laterally by integral flanks 45, which are in close proximity to the respective sides 46 and 47 of the staple strip. Manufacturing the plate of a metallic material and arranging the flanks so that the distance between them is only negligibly greater than the width b of the staple strip offers the advantage of guiding the staple strip accurately in the lateral direction which, as will be clear from the following, is of considerable benefit. The plate 42 is also provided with a forming block 48 over which the staple blanks 10 are bent in a manner which will be described below. The mid-section 49 of the plate 42 is provided with a raised area whose edges 50 extend in the longitudinal direction of the staple strip. A feed plate 51 provided with guide pins 52, which interact with the raised edges 50, is positioned between the plate 42 and the staple strip 11. The feed plate 51 can be moved in a reciprocating forward-backward movement along the staple strip 11. The feed plate is fed forward by the feeder device 17, which is shown only schematically in FIG. 6, and in the direction opposite to the forward direction by interaction between the forming punch 19 and the contact arms 53 on the feed plate, in a manner which will be described below. The feed plate is provided with spring tabs 54, which spring downward when the feed plate is moved backward by the forming punch and grip the staple strip 11 when the plate is fed forward by the feeder device, resulting in forward feeding of the staple blanks.

Figure 12:
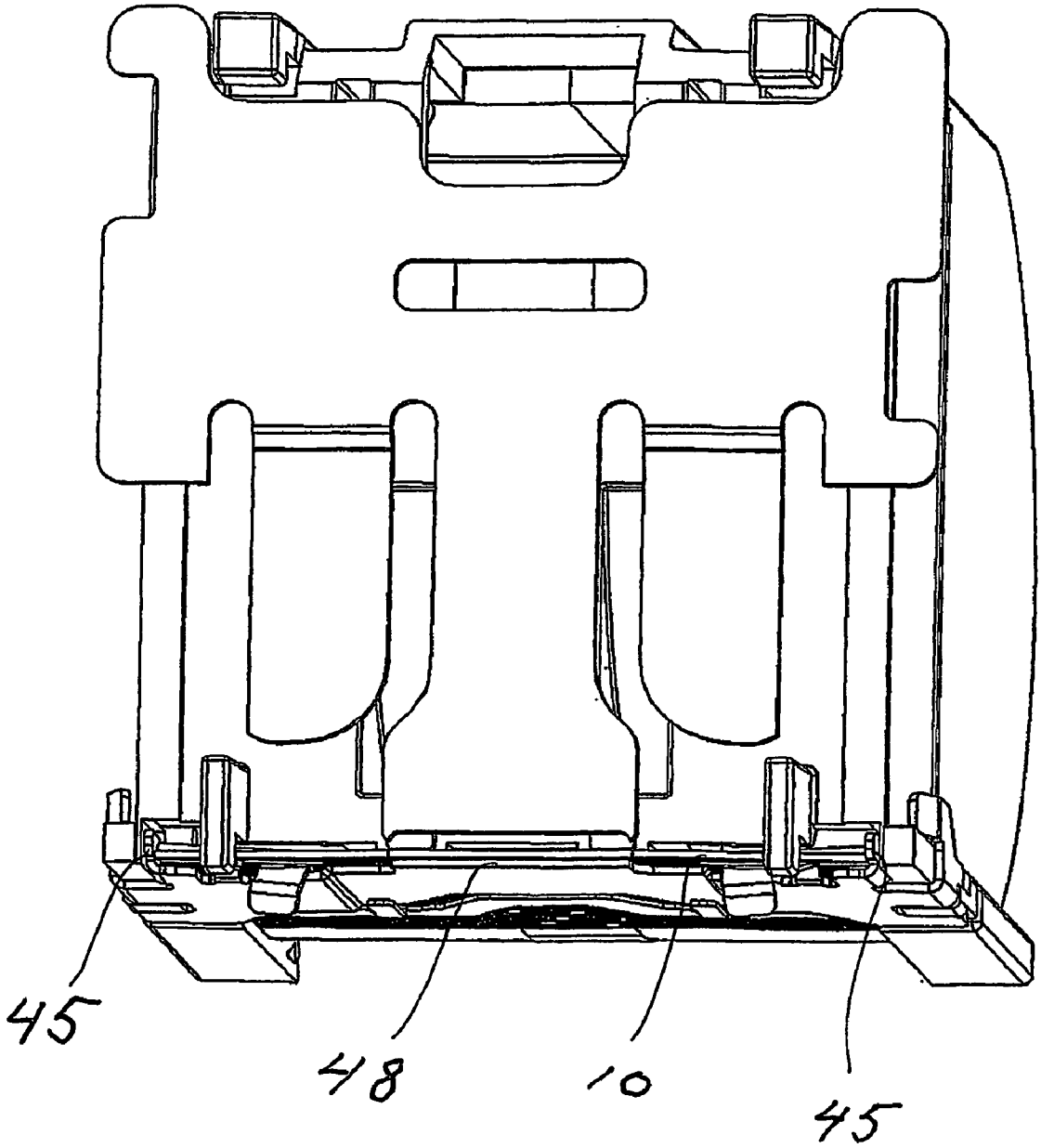
FIGS. 12-14 show a sequence in which a staple blank is bent into the shape of a staple by the forming punch.
Figure 13:
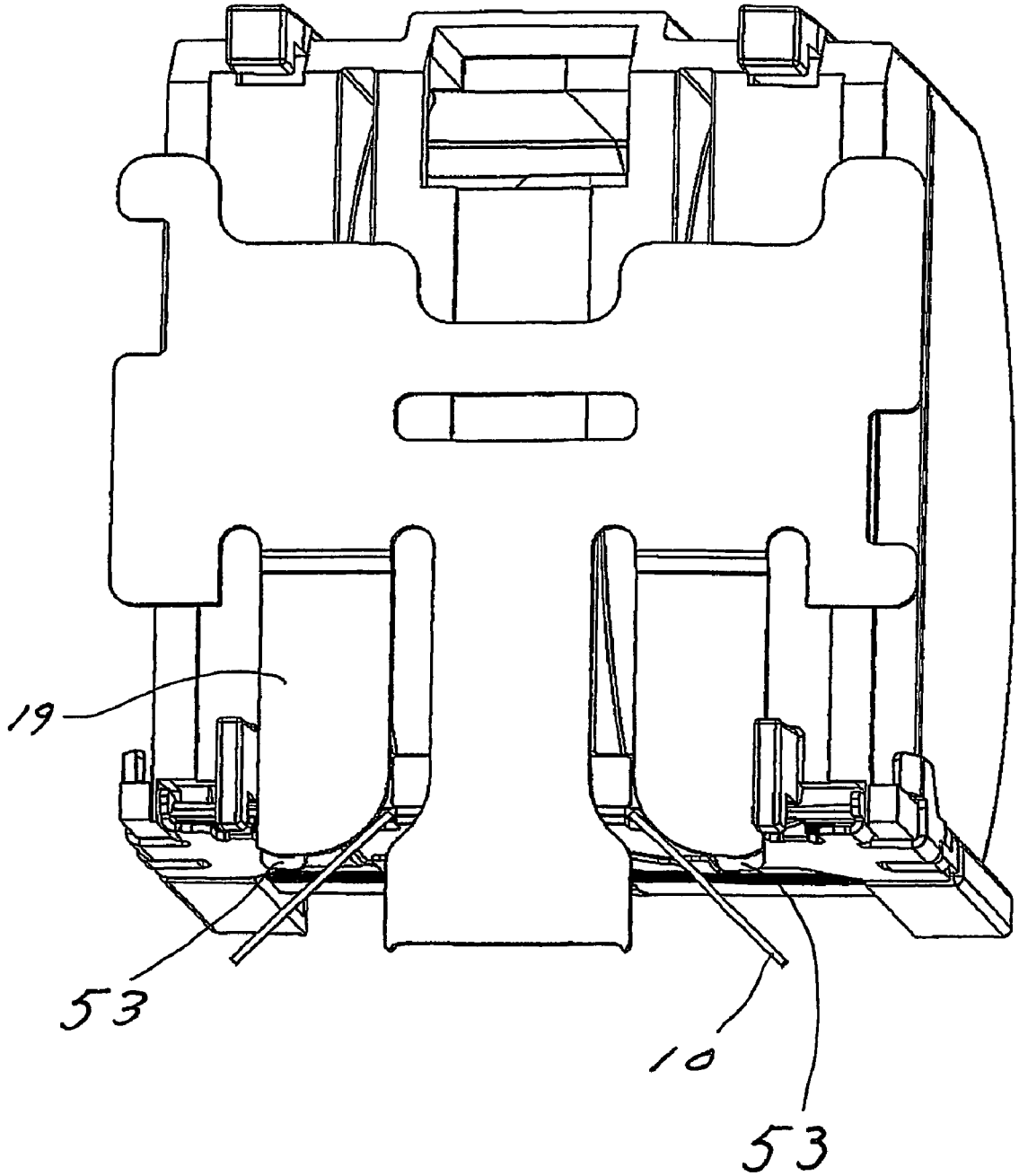
Figure 14:
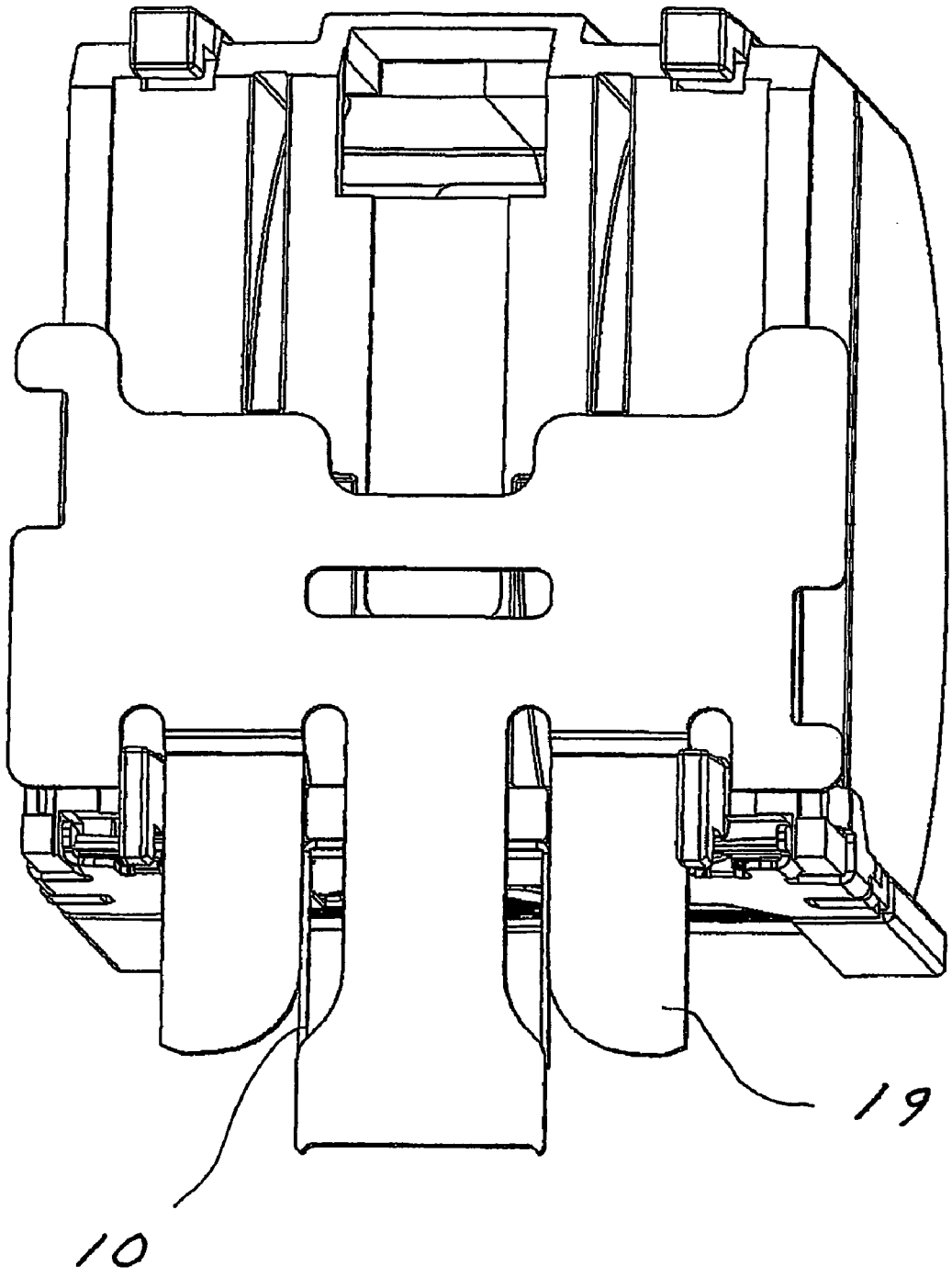

A sequence in which a staple blank 10 is bent into the shape of a finished staple over a forming block 48 will hereinafter be described with reference to FIGS. 12-14, in which the container 8 is shown essentially from the side connected to the staple forming arrangement and in which the forming punch 19 is also shown. In the initial position shown in FIG. 12, a staple blank 10 is shown fed forward to a position in which it is located over the forming block 48. Since, in this position, the staple blank is guided by the flanks 45, and since the distance between the flanks is negligibly greater than the length of the staple blank 10, the staple blank is centred relative to the forming block 48. Furthermore, since the flanks 45 consist of a metallic material, the staple blanks cannot score the flanks, with the risk that the staple blanks may be displaced off-centre relative to the forming block. In FIG. 13, the forming punch 19 has been driven downward by the drive arms 16, which are not shown in the figures, and have started to bend the staple blank, while the forming punch is in contact with the contact arms 53 on the feed plate, which is thereby moved backward. In FIG. 14, the forming punch 19 has moved to its lowermost position and the staple blank 10 has been bent into the shape of a staple over the forming block 48. The forming punch is then returned to the position shown in FIG. 12 and contact between the forming punch 19 and contact arms 53 is interrupted, following which the feeder device feeds a new staple blank to the forming block.

The present invention is obviously not limited by the foregoing description, but only by the claims stated below.

The invention claimed is:

1. A staple magazine for mounting to a stapler, the staple magazine comprising:

a container, which stores a plurality of elongated staple blanks in strip form, the staple blanks being fed by a feeder plate to a forming block along a feed path incorporated in the container; and a staple forming arrangement attached to said container and including a forming punch that bends one of the plurality of staple blanks over the forming block so as to form a bent staple, and a driving punch that drives the bent staple into a workpiece, the forming punch and the driving punch being driven in a reciprocating movement to form and drive the bent staple by a drive arrangement incorporated in the stapler, wherein said staple forming arrangement is nondestructively detachable from said container so as to be reusable with a replacement container.

2. The staple magazine according to claim 1, wherein one of said container and said staple forming arrangement is provided with at least one catching portion and the other of said container and said staple forming arrangement is provided with a corresponding opening for each catching portion, and wherein said staple forming arrangement is attached to said container by engaging each catching portion with the corresponding opening.

3. The staple magazine according to claim 1, wherein the forming block is carried by said container.

4. The staple magazine according to claim 1, wherein inner walls of the feed path are made of metallic material.

5. The staple magazine according to claim 1, wherein the feed path has a width slightly greater than a width of the strip of elongated staple blanks.

6. The staple magazine according to claim 1, wherein the feeder plate is carried by said container.

7. A staple magazine for mounting to a stapler, the staple magazine comprising:

a container, which stores a plurality of elongated staple blanks in strip form, the staple blanks being fed by a feeder plate to a forming block along a feed path incorporated in the container;

a staple forming arrangement including a forming punch that bends one of the plurality of elongated staple blanks over the forming block so as to form a bent staple, and a driving punch that drives the bent staple into a workpiece, the forming punch and the driving punch being driven in a reciprocating movement to form and drive the bent staple by a drive arrangement incorporated in the stapler; and means for attaching said container to said staple forming arrangement such that said staple forming arrangement is nondestructively detachable from said container.

8. The staple magazine according to claim 7, wherein said attaching means includes at least one catching portion provided on one of said container and said staple forming arrangement, and a corresponding opening for each catching portion provided on the other of said container and said staple forming arrangement.

9. The staple magazine according to claim 7, wherein the forming block is carried by said container.

10. The staple magazine according to claim 7, wherein inner walls of the feed path are made of metallic material.

11. The staple magazine according to claim 7, wherein the feed path has a width slightly greater than a width of the strip of elongated staple blanks.

12. The staple magazine according to claim 7, wherein the feeder plate is carried by said container.

13. A container constructed to be connected to a staple forming arrangement so as to form a staple magazine for mounting to a stapler, the staple forming arrangement including a forming punch that bends one of a plurality of elongated staple blanks over a forming block so as to form a bent staple and a driving punch that drives the bent staple into a workpiece, the container comprising:

a staple storing portion, which stores the plurality of elongated staple blanks in strip form;

a feed path, along which the staple blanks are fed by a feeder plate to the forming block; and means for attaching said container to said staple forming arrangement such that the staple forming arrangement is nondestructively detachable from said container.

14. The container according to claim 13, wherein said attaching means includes at least one catching portion provided on said container and configured to engage with a corresponding opening provided on said staple forming arrangement.

15. The container according to claim 13, wherein the forming block is carried by said container.

16. The container according to claim 13, wherein inner walls of the feed path are made of metallic material.

17. The container according to claim 13, wherein the feed path has a width slightly greater than a width of the strip of elongated staple blanks.

18. The container according to claim 13, wherein the feeder plate is carried by said container.

19. A container constructed to be connected to a staple forming arrangement so as to form a staple magazine for mounting to a stapler, the staple forming arrangement including a forming punch that bends one of a plurality of elongated staple blanks over a forming block so as to form a bent staple and a driving punch that drives the bent staple into a workpiece, the container comprising:

a staple storing portion, which stores the plurality of elongated staple blanks in strip form; and a feed path, along which the staple blanks are fed by a feeder plate to the forming block; and attachment portions configured to be connected to said staple forming arrangement such that said staple forming arrangement is nondestructively detachable from said container.

20. The container according to claim 19, wherein the attachment portions include at least one catching portion provided on said container and configured to engage with a corresponding opening provided on said staple forming arrangement.

21. The container according to claim 19, wherein the forming block is carried by said container.

22. The container according to claim 19, wherein inner walls of the feed path are made of metallic material.

23. The container according to claim 19, wherein the feed path has a width slightly greater than a width of the strip of elongated staple blanks.

24. The container according to claim 19, wherein the feeder plate is carried by said container.

25. An apparatus for forming a staple magazine for mounting to a stapler, comprising:

a container, configured to store a plurality of elongated staple blanks in strip form, the staple blanks being fed to a forming block along a feed path incorporated in the container; and a staple forming arrangement to be attached to said container and including a forming punch that bends one of the plurality of elongated staple blanks over the forming block so as to form a bent staple, and a driving punch that drives the bent staple into a workpiece, the forming punch and the driving punch being driven in a reciprocating movement to form and drive the bent staple by a drive arrangement incorporated in the stapler, wherein said staple forming arrangement and said container are constructed such that the staple forming arrangement is nondestructively detachable from said container so as to be reusable with a replacement container.

26. The apparatus according to claim 25, wherein one of said container and said staple forming arrangement is provided with at least one catching portion and the other of said container and said staple forming arrangement is provided with a corresponding opening for each catching portion, and wherein said staple forming arrangement is configured to be attached to said container by engaging each catching portion with the corresponding opening.

27. The apparatus according to claim 25, wherein the forming block is carried by said container.

28. The apparatus according to claim 25, wherein inner walls of the feed path are made of metallic material.

29. The apparatus according to claim 25, wherein the feed path has a width slightly greater than a width of the strip of elongated staple blanks.

30. The apparatus according to claim 25, wherein the feeder plate is carried by said container.

31. An apparatus for forming a staple magazine for mounting to a stapler, comprising:

a container, configured to store a plurality of elongated staple blanks in strip form, the staple blanks being fed to a forming block along a feed path incorporated in the container; and a staple forming arrangement configured to be attached to said container and including a forming punch that bends one of the plurality of elongated staple blanks over the forming block so as to form a bent staple, and a driving punch that drives the bent staple into a workpiece, the forming punch and the driving punch being driven in a reciprocating movement to form and drive the bent staple by a drive arrangement incorporated in the stapler, wherein said staple forming arrangement and said container are provided with means for attaching said container to said staple forming arrangement such that said staple forming arrangement is nondestructively detachable from said container.

32. The apparatus according to claim 31, wherein said attaching means includes at least one catching portion provided on one of said container and said staple forming arrangement, and a corresponding opening for each catching portion is provided on the other of said container and said staple forming arrangement.

33. The apparatus according to claim 31, wherein the forming block is carried by said container.

34. The apparatus according to claim 31, wherein inner walls of the feed path are made of metallic material.

35. The apparatus according to claim 31, wherein the feed path has a width slightly greater than a width of the strip of elongated staple blanks.

36. The apparatus according to claim 31, wherein the feeder plate is carried by said container.

* * * * *